US009759123B2

(12) United States Patent
Le Poul et al.

(10) Patent No.: US 9,759,123 B2
(45) Date of Patent: Sep. 12, 2017

(54) LIQUID CONTAINER AND DEVICE FOR ADJUSTING THE LIQUID PHASE OF A COOLING CIRCUIT OF A HEAT ENGINE HAVING SUCH A CONTAINER BUILT-IN

(71) Applicant: TRISTONE FLOWTECH SOLUTIONS (TFS), Carquefou (FR)

(72) Inventors: Louis-Philippe Le Poul, Riaille (FR); Ghislain Gaudiau, Ancenis (FR); Caroline Archambeault, Bouguenais (FR); Luc N'Kaoua, Nantes (FR); Dominique Saint-Lary, Nantes (FR); Sylvain Merour, Vertou (FR)

(73) Assignee: TRISTONE FLOWTECH SOLUTIONS (TFS), Carquefou (FR)

( * ) Notice: Subject to any disclaimer, the term of this patent is extended or adjusted under 35 U.S.C. 154(b) by 154 days.

(21) Appl. No.: 14/758,577

(22) PCT Filed: Jan. 2, 2014

(86) PCT No.: PCT/FR2014/050001

§ 371 (c)(1),
(2) Date: Jun. 30, 2015

(87) PCT Pub. No.: WO2014/111640

PCT Pub. Date: Jul. 24, 2014

(65) Prior Publication Data

US 2015/0345368 A1 Dec. 3, 2015

(30) Foreign Application Priority Data

Jan. 15, 2013 (FR) ..... 13 50324
Jan. 2, 2014 (FR) ..... 14 50003

(51) Int. Cl.
*E03B 11/00* (2006.01)
*F01P 11/02* (2006.01)
(Continued)

(52) U.S. Cl.
CPC ..... *F01P 11/02* (2013.01); *B65D 25/04* (2013.01); *B65D 39/0005* (2013.01);
(Continued)

(58) Field of Classification Search
CPC ..... F01P 11/0214; F01P 11/02; F01P 11/029; F01P 11/0209; F01P 2011/0219;
(Continued)

(56) References Cited

U.S. PATENT DOCUMENTS 5,123,436 A * 6/1992 Koechlein ..... G05D 16/0666 137/12
5,680,833 A * 10/1997 Smith ..... F01P 11/029 123/41.54
(Continued)

FOREIGN PATENT DOCUMENTS

DE 2854178 A1 6/1980
DE 19948226 A1 4/2001
(Continued)

OTHER PUBLICATIONS

International Search Report, dated Mar. 21, 2014, from corresponding PCT application, PCT/FR2014/05001.

*Primary Examiner* — Jessica Cahill
(74) *Attorney, Agent, or Firm* — Ipsilon USA, LLP

(57) ABSTRACT

A liquid container including: at least two compartments (2; 3) which are each provided with a fluid inlet and outlet and which are connectable to a fluid flow circuit, respectively, at least one communication area (4) between the compartments (2; 3), at least one opening (5) for filling the container, at least one plug (6) for closing the opening (5) for filling the container, the opening (5) for filling the container is an opening common to the compartments (2, 3) and the container further includes at least one member (7) for closing the communication area (4) between the compartments (2,
(Continued)

3), the closing member being movably mounted between an open position of the area and a closed position of the area, the closing member being in a closed position of the area in a closed position of the filling opening plug.

16 Claims, 10 Drawing Sheets

(51) Int. Cl.
*B65D 39/00* (2006.01)
*B65D 41/04* (2006.01)
*B65D 51/16* (2006.01)
*B65D 25/04* (2006.01)

(52) U.S. Cl.
CPC ..... *B65D 41/04* (2013.01); *B65D 51/1644* (2013.01); *F01P 11/029* (2013.01); *F01P 11/0209* (2013.01); *F01P 11/0238* (2013.01)

(58) Field of Classification Search
CPC .... B65D 25/04; B65D 39/0005; B65D 41/04; B65D 51/1644
See application file for complete search history.

(56) References Cited

U.S. PATENT DOCUMENTS

| | | | | |
|---|---|---|---|---|
| 6,056,139 | A * | 5/2000 | Gericke | F01P 11/0247 220/203.06 |
| 6,718,916 | B2 | 4/2004 | Hewkin | |
| 7,216,610 | B2 * | 5/2007 | Dunkle | F01P 11/0238 123/41.54 |
| 8,074,819 | B2 * | 12/2011 | Dexter | F01P 11/029 137/571 |
| 2006/0118067 | A1 * | 6/2006 | Hewkin | F01P 11/029 123/41.54 |
| 2010/0206882 | A1 * | 8/2010 | Wessels | F01P 11/029 220/562 |

FOREIGN PATENT DOCUMENTS

| | | | |
|---|---|---|---|
| EP | 1260685 | A2 | 11/2002 |
| EP | 2221462 | A1 | 8/2010 |
| WO | 9910636 | A1 | 3/1999 |

* cited by examiner

Détail B

Detail C

Detail D

LIQUID CONTAINER AND DEVICE FOR ADJUSTING THE LIQUID PHASE OF A COOLING CIRCUIT OF A HEAT ENGINE HAVING SUCH A CONTAINER BUILT-IN

The present invention relates to a liquid tank, and to regulator apparatus including such a tank for regulating the liquid phase of a cooling circuit for cooling an internal combustion engine.

It relates more particularly to a liquid tank, in particular for a motor vehicle, said tank comprising:

at least two compartments, each of which is equipped with a fluid inlet and with a fluid outlet, and is connectable to a respective fluid flow circuit via said inlet and via said outlet;

at least one closable communication zone providing communication between said compartments that is suitable for allowing at least the contents of one of the compartments to pass through into the other compartment;

at least one closure member for closing off said communication zone between compartments, said closure member being mounted to move between an open position in which said zone is open and a closed position in which said zone is closed;

at least one filler opening for filling said tank; and at least one stopper for closing said filler opening.

Numerous liquid tanks are present in a vehicle. In particular, in the cooling circuit for cooling the engine, a tank is generally provided that provides the functions of acting as a degassing chamber, as means for compensating for any losses by micro-leakage from the cooling circuit, and as means for filling and for topping up the circuit with liquid coolant. Such a tank may be compartmented so that one of its compartments is used for the above-mentioned functions, while the other compartment is used for an auxiliary circuit. Generally, the fluids circulating in the two compartments are at different temperatures. It is therefore necessary for the two compartments not to communicate with each other while the vehicle is running.

Currently, such a two-compartment tank is equipped with two filler openings, each of which is suitable for enabling a respective compartment to be filled. It is therefore also necessary to have two stoppers. In addition, the filling times are unavoidably long because it is necessary to unscrew the two stoppers and to screw them back on.

An object of the present invention is to propose a liquid tank of the above-mentioned type having a design that makes it possible to simplify the architecture and to reduce the filling time for filling said tank without adversely affecting operation of said tank.

To this end, the invention provides a liquid tank, in particular for a motor vehicle, said tank comprising:

at least two compartments, each of which is equipped with a fluid inlet and with a fluid outlet, and is connectable to a respective fluid flow circuit via said inlet and via said outlet;

at least one closable communication zone providing communication between said compartments that is suitable for allowing at least the contents of one of the compartments to pass through into the other compartment;

at least one closure member for closing off said communication zone between compartments, said closure member being mounted to move between an open position in which said zone is open and a closed position in which said zone is closed;

at least one filler opening for filling said tank; and at least one stopper for closing said filler opening;

said liquid tank being characterized in that the filler opening of the tank is a preferably single opening, common to both of the compartments, and in that said closure member is in the closed position in which said communication zone is closed when the stopper of the filler opening is in the closed position.

The fact that the filler opening of the tank is an opening that is common to the compartments so as to allow both of the compartments to be filled via the same filler opening saves time.

The fact that the tank includes at least one closure member for closing the communication zone between compartments, which member is suitable for going from the open position to the closed position under the action of said stopper while the stopper is going from the open position to the closed position, and, conversely, from the closed position to the open position while the stopper is going from the closed position to the open position, guarantees that the overall assembly operates properly and that there is no communication between compartments at said zone when the stopper is closed.

Preferably, in a first preferred embodiment of the invention, the closure member and the stopper are made in the form of two distinct parts. In this embodiment, the closure member is equipped with return means for urging it to return to the open position, and the stopper acts as an active pusher by applying thrust to said closure member, in opposition to the return means, while said stopper is going from the open position to the closed position.

In another embodiment of the invention, the closure member and the stopper form a one-piece unit Preferably, the filler opening is extended into the tank by a dip tube provided with two "communication" openings that are mutually offset axially, the tube opening out into one of the compartments via one of said communication openings and the tube opening out into the other compartment via the other of said communication openings.

In co-operation with said openings, the tube forms the communication zone providing communication between compartments.

This communication zone is formed by the zone inside the dip tube that separates said openings and that forms a link zone between said openings. Each tank is provided with a maximum filling level and said communication zone is preferably disposed above the maximum level of each compartment.

Preferably, the closure member is in the form of a dip element provided with a sealing gasket positioned inside the dip tube, this sealing gasket being disposed at the zone of the dip tube that is disposed between said openings of said tube when the stopper of the filler opening is in the closed position.

This sealing gasket of the dip element co-operates with the end-wall of the dip tube that is formed by the free end of the dip tube, i.e. the end of the tube that is opposite from the end that extends the filler opening, to form the closable communication zone between said compartments.

Preferably, the communication openings of the dip tube are provided in the vicinity of the free end of the dip tube.

Preferably, the stopper of the filler opening is thus in the form of a screw cap that is screwed onto the threaded neck of the filler opening of the tank when said stopper is in the closed position.

Since the stopper is a screw stopper and the filler opening is provided with a threaded neck, the stopper is held securely on the neck of the filler opening.

Preferably, the stopper of the filler opening is provided with a valve having a valve member and in which the valve member is mounted to move between an open position and a closed position, said valve member being suitable for going from the closed position to the open position beyond a predetermined "calibration" pressure inside the tank, at the filler opening of said tank.

Preferably, each compartment is provided with an air escape opening.

Preferably, the air escape opening of one of the compartments is provided with a valve having a valve member and in which the valve member is mounted to move between a closed position and an open position, said valve member being suitable for going from the closed position to the open position beyond a predetermined "calibration" pressure inside the tank compartment equipped with said valve. By means of this valve, the internal pressure in each compartment may be different from one compartment to the other.

Preferably, the calibration pressure of the valve member of the valve equipping the air escape opening of one of the compartments is greater than the calibration pressure of the valve member of the valve equipping the closure stopper.

Preferably, the valve of the air escape opening of one of the compartments is mounted to be constrained to move with the closure member of the communication zone.

Preferably, the air escape openings of the compartments open out into the dip tube.

Preferably, the tank is made up of two half-shells assembled together via a gasket plane.

The tank is preferably a molded piece of synthetic material.

The invention also provides regulator apparatus for regulating the liquid phase of a cooling circuit of an internal combustion engine, said regulator apparatus comprising a tank having two compartments, one of which is connected to the cooling circuit of said engine, and the other of which is connected to an auxiliary circuit, said regulator apparatus being characterized in that the tank is of the above-mentioned type.

The invention can be well understood on reading the following description of embodiments given with reference to the accompanying drawings, in which:

FIG. 9 is a fragmentary section view of another embodiment of a tank of the invention showing the closed position of the stopper and of the closure member for closing off the communication zone between compartments;

Figure 1:
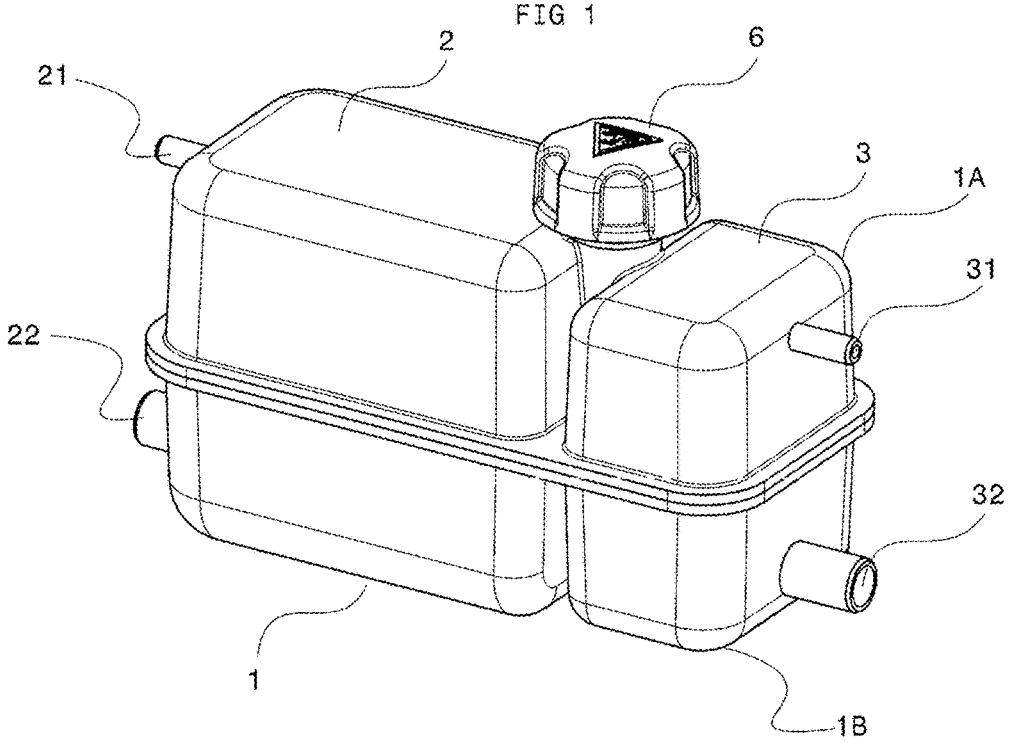
FIG. 1 is a perspective view of a tank of the invention.

As mentioned above, the liquid tank 1 of the invention is a multi-compartment tank. In particular, this tank comprises two compartments 2; 3, each of which is equipped with a fluid inlet 21; 31 and with a fluid outlet 22; 32. The inlet 21 and the outlet 22 of the compartment shown at 2 in the figures are connectable to a fluid flow circuit 13, while the inlet 31 and the outlet 32 of the compartment shown at 3 in the figures are connectable to a fluid flow circuit 14. The fluid inlets 21; 31 are positioned in the top portion of the tank and the fluid outlets 22; 32 are positioned in the bottom portion of said tank.

Figure 2:
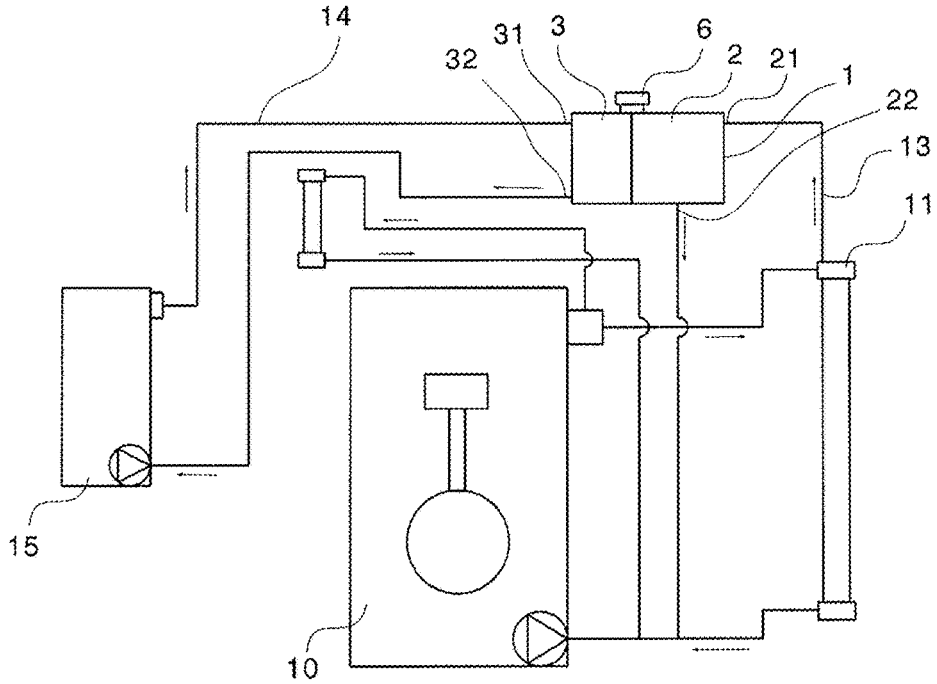
FIG. 2 is a diagrammatic view of a fluid flow installation equipped with a tank of the invention.
Figure 3:
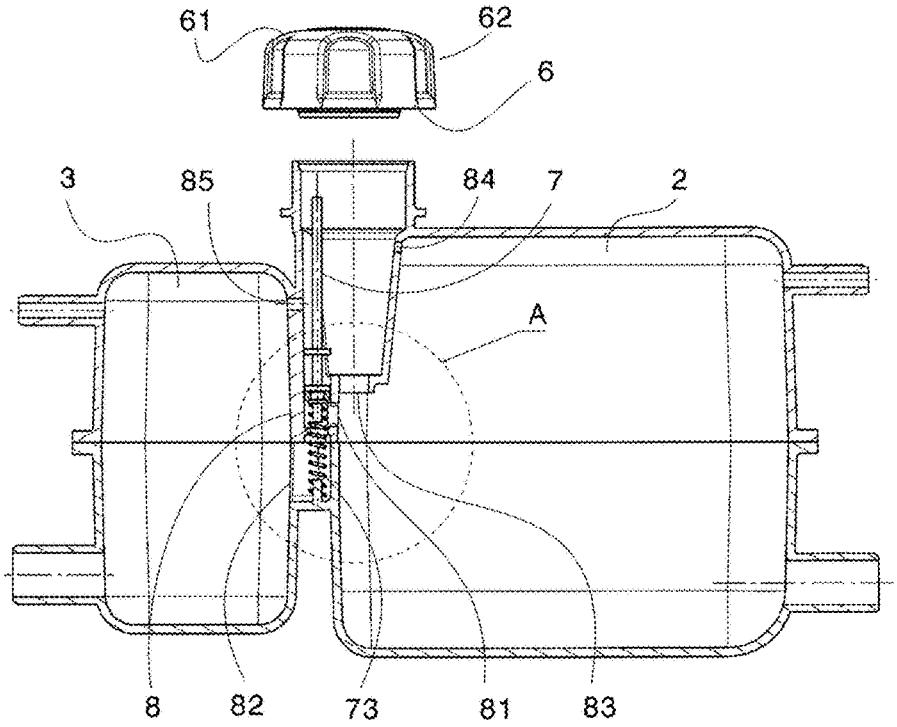
FIG. 3 is a section view of a first embodiment of a tank of the invention showing the open position of the stopper and of the closure member for closing off the communication zone providing communication between compartments.
Figure 4:
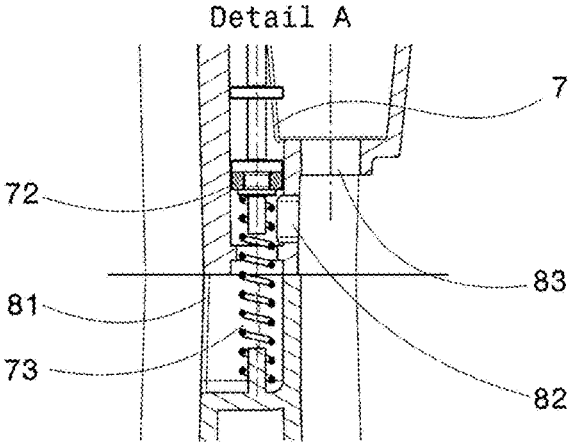
FIG. 4 is a view of detail A of FIG. 3.
Figure 5:
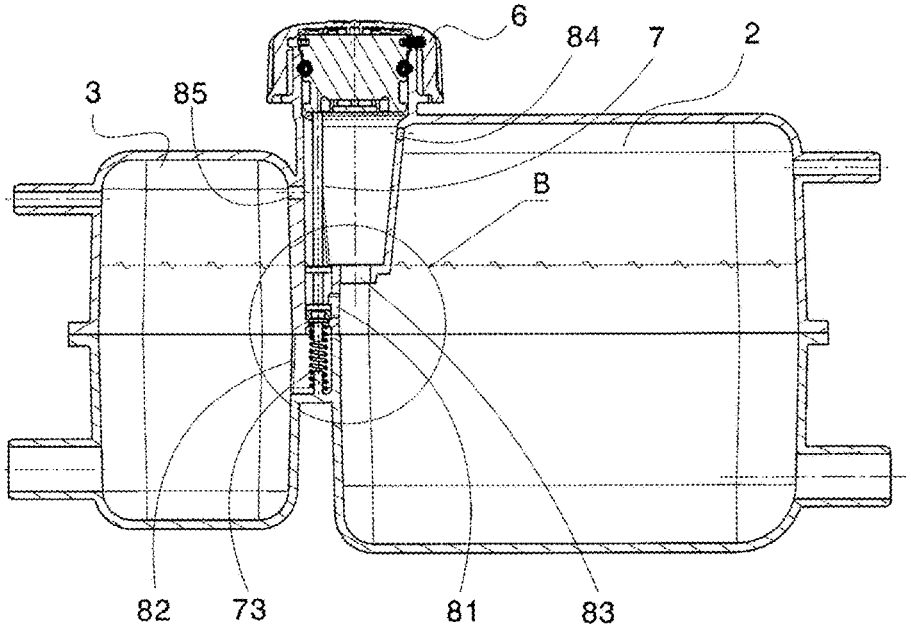
FIG. 5 is a section view of a first embodiment of a tank of the invention showing the closed position of the stopper and of the closure member for closing off the communication zone between compartments.
Figure 6:
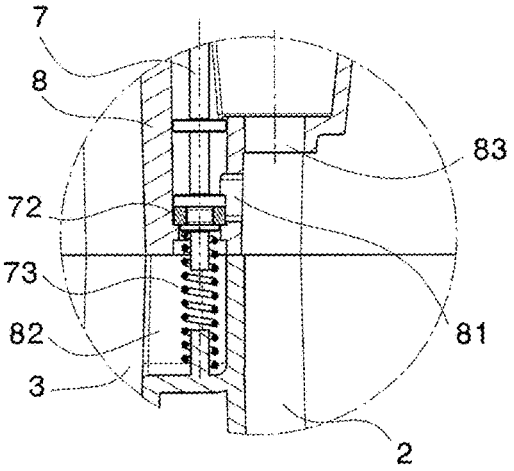
FIG. 6 is a view of detail B of FIG. 5.
Figure 7:
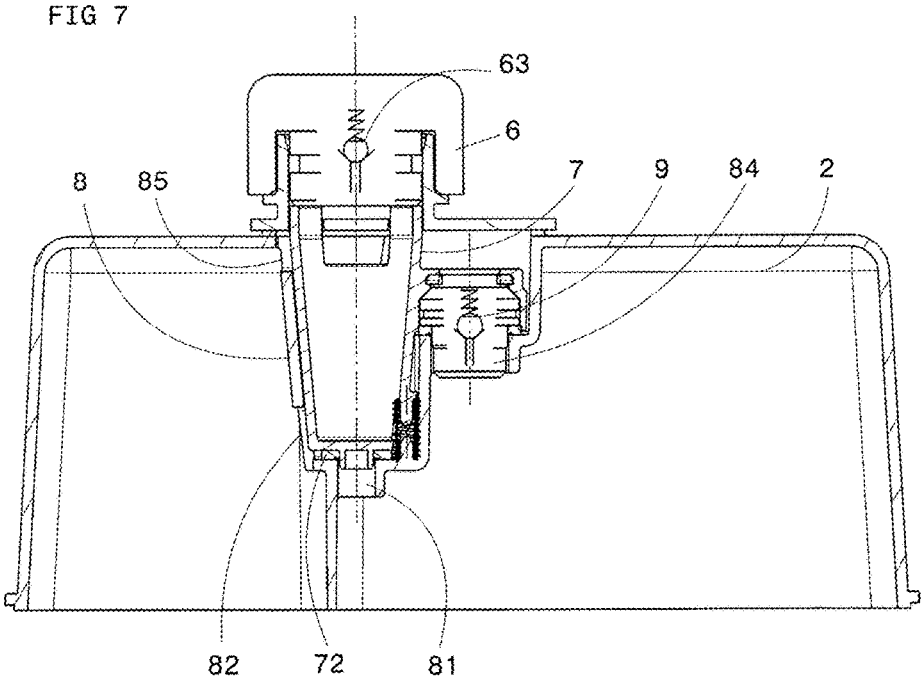
FIG. 7 is a fragmentary section view of another embodiment of a tank of the invention showing the closed position of the stopper and of the closure member for closing off the communication zone between compartments.
Figure 8:
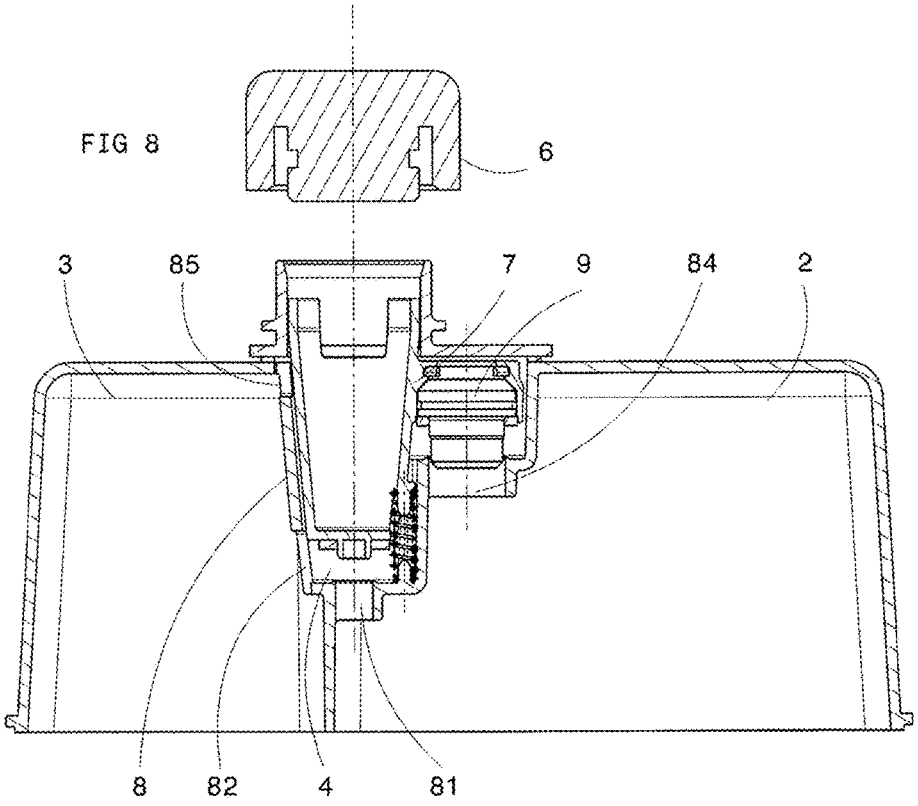
FIG. 8 is a fragmentary section view of another embodiment of a tank of the invention showing the open position of the stopper and of the closure member for closing off the communication zone between compartments.
Figure 8:
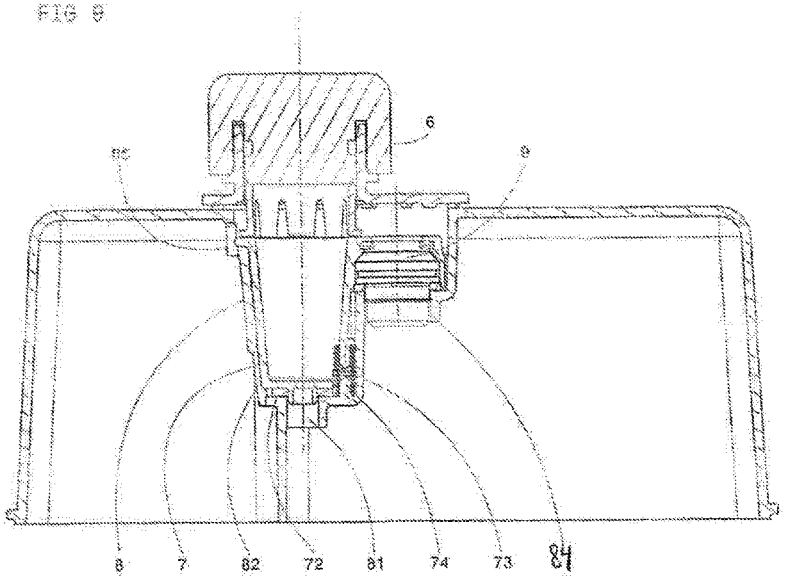

In the example, shown said tank is installed in the cooling circuit 13 for cooling an internal combustion engine 10. Naturally, this liquid tank is suitable for containing any other type of liquid rather than a liquid coolant, and the invention applies to any tank having at least two compartments. Thus, the compartment shown at 2 in the Figures is fed via its inlet 21 with cooling fluid coming from the radiator 11 of the engine 10 via a circuit shown at 13, this fluid being removed via the outlet 22 of the compartment 2 that is provided in the bottom portion of the compartment 2 so as to return to a circulation pump provided in the cooling circuit of the engine and so as to serve to provide head for the cooling circuit. The compartment shown at 3 is fed at its inlet 31 via a circuit, shown at 14 in FIG. 2, this circuit passing through an auxiliary element 15, such as a supercharged air cooler, an electric motor, or a set of batteries, for example.

The fluid feeding the compartment 3 via the inlet 31 is removed from the compartment 3 via an outlet 32 provided in the bottom portion of the compartment, by pumping means disposed in the circuit connecting said outlet to the auxiliary element 15. Naturally, the integration of the tank as it is described above is merely one embodiment.

The tank, as described above, also has a closable communication zone 4 providing communication between said compartments 2; 3, which zone is suitable for allowing at least the liquid contents of one of the compartments to pass through into the other compartment, a filler opening 5 for filling said tank, and a stopper 6 for closing said filler opening 5.

In a manner characteristic of the invention, the filler opening 5 is common to both of the compartments so that it is possible, from said filler opening 5, to fill both compartments of the tank. In this example, the filler opening 5 is provided with a threaded neck and extends into the tank 1 via a dip tube 8, provided with two openings 81, 82 that are offset axially, the tube 8 opening out into compartment 2 via the opening 81, and opening out into compartment 3 via the opening 82.

In the example shown in FIGS. 3 to 6, the openings 81 and 82 are radial openings. In the example shown in FIGS. 7 to 11, one of these openings is axial, shown at 81, and the other is radial, shown at 82. Independently of their embodiments, the communication openings 81, 82 of the dip tube 8 are provided in the vicinity of the free end of the dip tube 8.

The stopper 6 of the filler opening 5 is thus in the form of a screw cap that is screwed onto the threaded neck of the filler opening 5 of the tank when said stopper is in the closed position. The cap is formed by an end wall 61 surrounded by a tapped cylindrical peripheral wall 62.

The stopper 6 of the filler opening 5 is provided with a valve 63 having a valve member and in which the valve member is mounted to move between an open position and a closed position, said valve member being suitable for going from the closed position to the open position beyond a predetermined "calibration" pressure inside the tank 1, at the filler opening 5 of said tank 1.

The tank 1 also has a closure member 7 mounted to move between an open position in which said closable communication zone 4 between the compartments is open and a closed position in which said zone 4 is closed. This closure member 7 is in the closed position in which said communication zone 4 is closed when the stopper 6 of the filler opening 5 is in the closed position.

This closure member 7 is in the form of a dip element 71 provided with a sealing gasket 72 positioned inside the dip tube 8, this sealing gasket 72 being disposed at the zone of the dip tube 8 that is disposed between said openings 81, 82 of said tube when the stopper 6 of the filler opening is in the closed position.

In the example shown in FIGS. 3 to 6, this closure member 7 is in the form of a dip rod 71 provided with a sealing gasket 72 positioned at the zone of the dip tube 8 that is disposed between said openings 81, 82 of said tube and obstructing said tube 8 when the stopper 6 of the filler opening is in the closed position.

In the example shown in FIGS. 7 to 11, the closure member 7 is formed of a blind elongate tubular body that is mounted to slide inside the dip tube 8, this tubular body having a radial opening in the vicinity of its closed end provided facing the free end of the dip tube 8. The opposite end of the tubular body is an open end that is disposed at the filler opening of the tank so that said tubular body is filled with filling liquid and discharges its contents via its radial opening into the dip tube 8.

In these two embodiments, the stopper and the closure member are made in the form of two distinct parts. In particular, the closure member 7 is equipped with return means 73 for urging it to return to the open position, and the stopper 6 acts as an active pusher by applying thrust to said closure member 7, in opposition to the return means 73, while said stopper 6 is going from the open position to the closed position.

In the example shown in FIGS. 3 to 6, the closure member 7 is a slidably mounted rod inserted into the dip tube and urged by a helical spring to return to a position in which the sealing gasket, which is an O-ring seal in this example, extends above the radial openings of the dip tube. It can also be noted that the dip tube 8 is further provided with an axial opening 83 opening out into one (2) of the compartments 2, 3 above the radial openings 81, 82 of said tube 8.

Thus, the compartments are filled via said axial opening and then the transfer from one compartment to the other takes place via the radial openings. When the stopper 6 is closed, it acts, via the inside of its cap, which is, for example, provided with an internal bulge at the end-wall of the cap, to bear on the top end of the rod so as to cause the rod to slide inside the dip tube to a position in which the sealing gasket is positioned at the zone of the dip tube 8 that is disposed between the openings 81, 82 of said tube and obstructs said tube 8 when the stopper 6 of the filler opening is in the closed state. Thus, any communication between the compartments via this zone is prevented.

In the example shown in FIGS. 7 to 11, the closure member 7 is a tubular body inserted into the dip tube 8, as mentioned above, and urged by a helical spring to return to a position in which the sealing gasket 72 equipping the closed end of the tubular body extends above the openings 81, 82 of the dip tube 8.

Independently of the embodiment chosen for the closure member 7, each compartment 2; 3 is provided with an air escape opening 84; 85. The air escape openings 84, 85 of the compartments 2, 3 open out into the dip tube 8.

In the example shown in FIGS. 7 to 11, the air escape opening 84 of the compartment 2 is provided with a valve 9 having a valve member and in which the valve member is mounted to move between a closed position and an open position. Said valve member is suitable for going from the closed position to the open position beyond a predetermined "calibration" pressure inside the compartment equipped with said valve 9. The calibration pressure of the valve member of the valve 9 equipping the air escape opening 84 of the compartment 2 is greater than the calibration pressure of the valve member of the valve 63 equipping the closure stopper 6. The valve of the air escape opening 84 of the compartment 2 is mounted to be constrained to move with the closure member 7 of the communication zone 4. To this end, the closure member 7 has a radial projection defining an open-ended recess inside which the valve 9 is inserted in interfitting manner. This valve 9 is provided externally with a sealing gasket to provide sealing from the liquid contained in the compartment 2. Thus, when the pressure prevailing inside the compartment 2 is greater than a predetermined value corresponding to the calibration pressure of the spring urging the valve member of the valve 9 to return to its closed position, that valve member opens, and air escapes into the dip tube 9 before it can exit from the tank via the valve of the stopper for closing the tank. It should be noted that the valves having valve members that are used are commercially available valves in which each valve member is urged to return to the closed position by a spring calibrated to a pressure that is a function of the pressure desired for opening.

Figure 10:
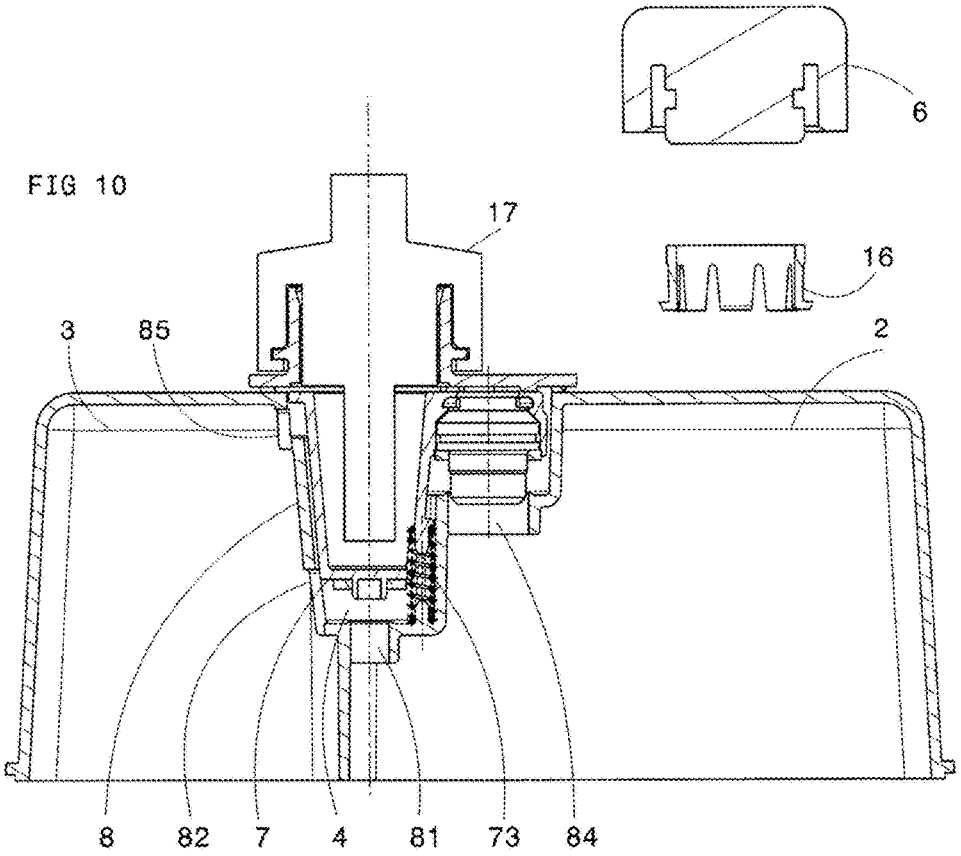
FIG. 10 is a fragmentary section view of a tank during the filling stage.
Figure 11:
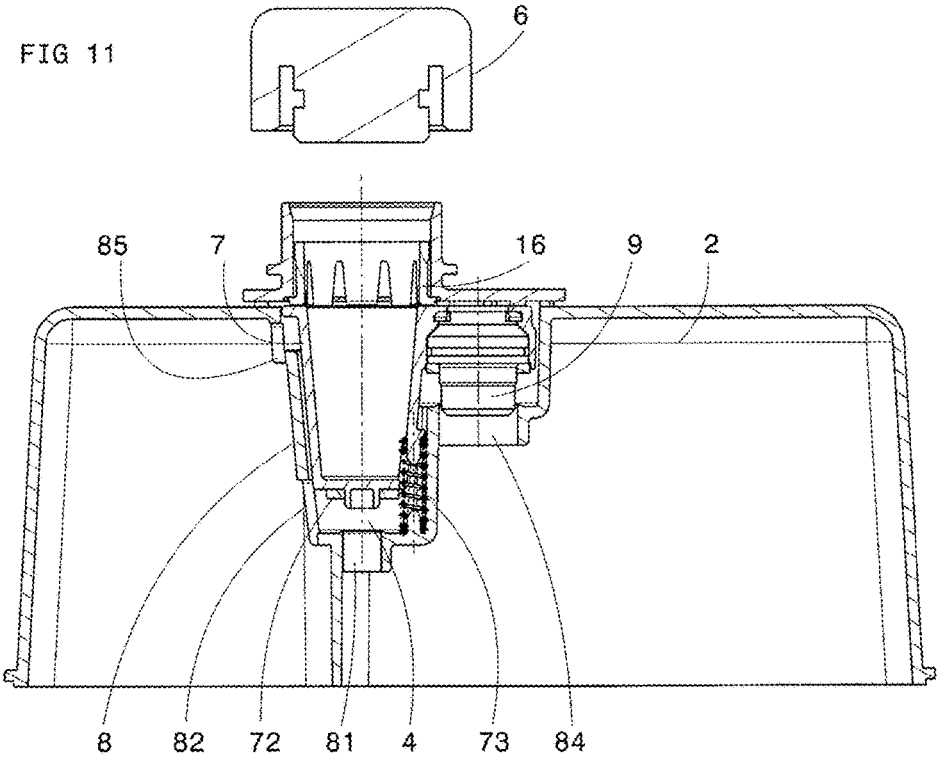
FIG. 11 is a fragmentary section view of the tank of FIG. 10 during its closure stage.
Figure 12:
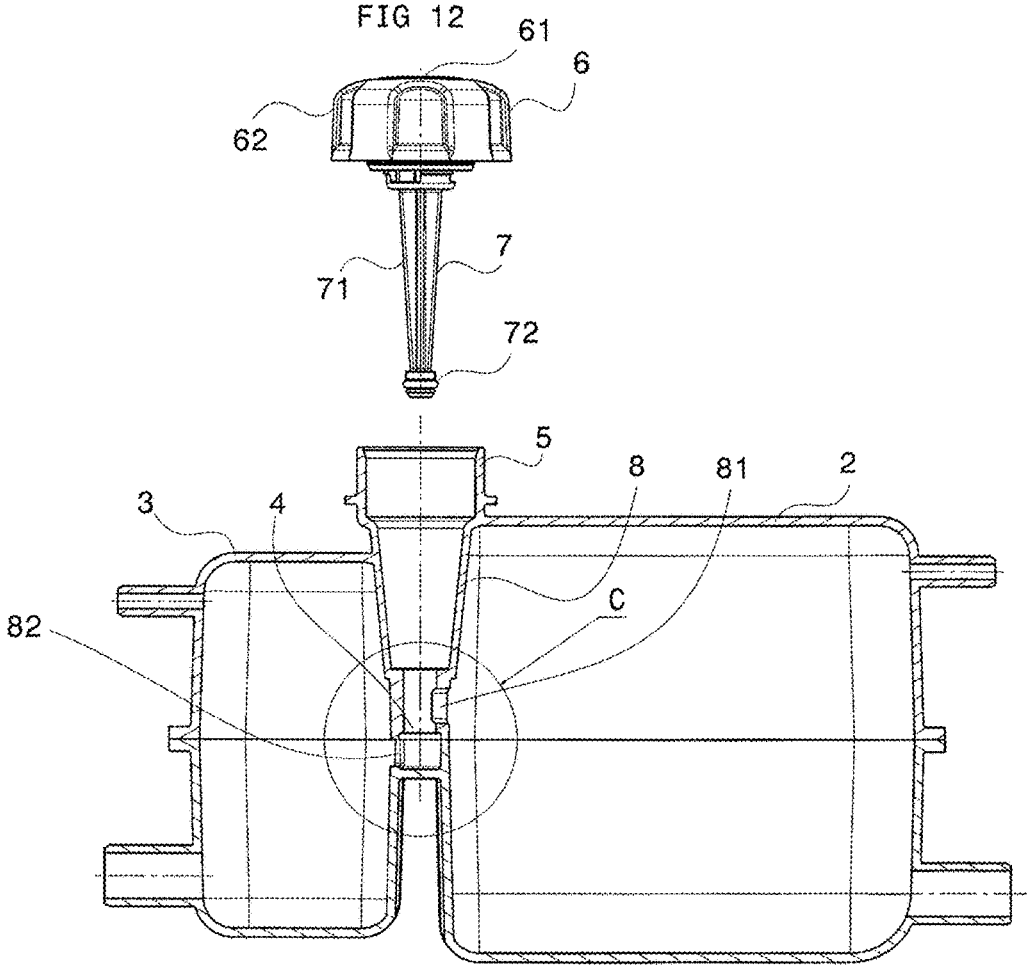
FIG. 12 is a section view of another embodiment of a tank of the invention showing the open position of the stopper and of the closure member for closing off the communication zone between compartments.
Figure 13:
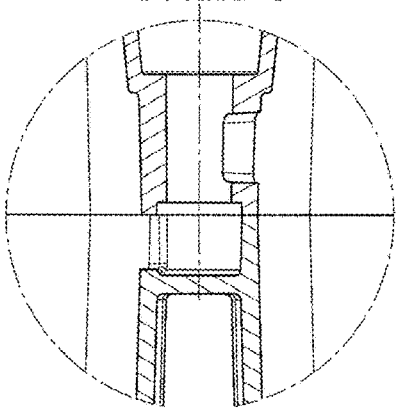
FIG. 13 is a view of detail C of FIG. 12.
Figure 14:
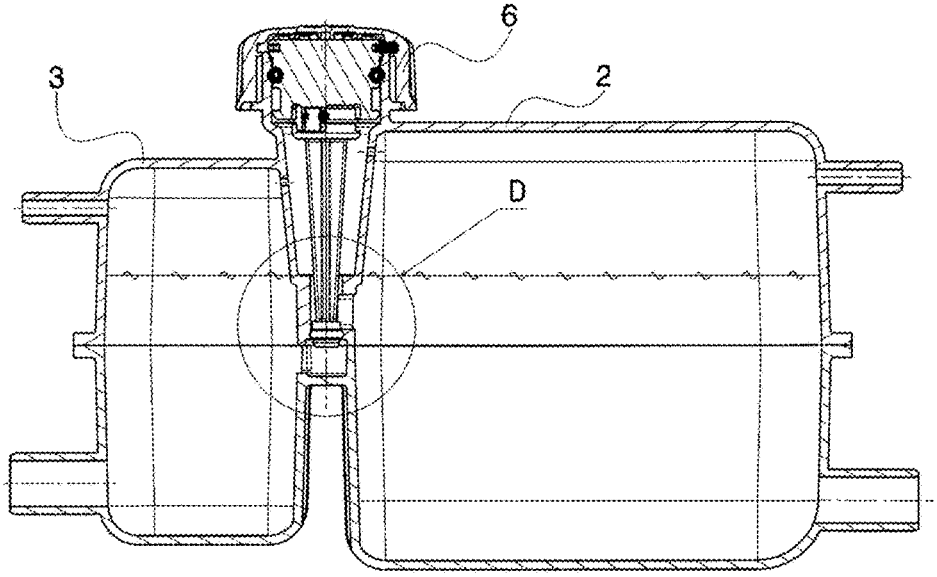
FIG. 14 is a section view of another embodiment of a tank of the invention showing the closed position of the stopper and of the closure member for closing off the communication zone between compartments.
Figure 15:
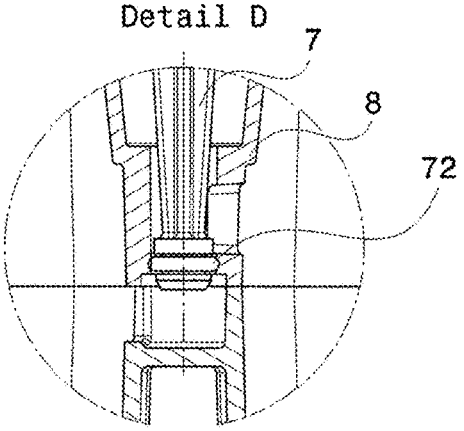
FIG. 15 is a view of detail D of FIG. 14.

FIGS. 10 and 11 show the situation in which the closure member 7 is made up of two portions, with the portion of the closure member that forms a bearing abutment for the stopper being in the form of a removable part suitable for being mounted after filling in the factory and shown at 16 in the figures. This spacer part 16 makes it possible, in the removed state, for the tank to be filled by means of a filling device that fits into the closure member as shown in FIG. 10. Once the filling has taken place, the spacer part 16 is mounted on the portion of the closure member that is already in place so as to increase the length of the closure member and so as to enable the stopper to act by applying thrust to said closure member as described above while said stopper is going from the open position to he closed position.

In the example shown in FIGS. 12 to 15, the closure member 7 and the stopper 6 form a one-piece unit. The rod 71 constituting the closure member 7 extends from the end-wall 61 of the cap. Thus, putting the stopper in place is achieved by inserting the rod 71 into the dip tube 8 and then by screwing the stopper onto the neck of the filler opening 5. In this screwed-on position, corresponding to the stopper being in the closed position, the sealing gasket, which, in this example, is an O-ring seal equipping the rod 71 of the closure member 7, obstructs the rod of the dip tube 8 in the zone of the tube that extends between said openings of the tube so that any communication between the two compartments is prevented.

By means of the tank as described above, the architecture is simplified, and the filling time is reduced without adversely affecting overall operation.

The invention claimed is:

1. A liquid tank for a motor vehicle, said tank comprising: at least two compartments, each of which is equipped with a fluid inlet and with a fluid outlet, and is connectable to a respective fluid flow circuit, via said inlets and via said outlets; at least one closable communication zone providing communication between said compartments that is suitable for allowing at least the contents of one of the compartments to pass through into the other compartment; at least one closure member for closing off said communication zone between compartments, said closure member being mounted to move between an open position in which said zone is open and a closed position in which said zone is closed; at least one filler opening for filling said tank; and at least one stopper for closing said filler opening; wherein the filler opening of the tank is a single opening, common to both of the compartments, and in that said closure member is in the closed position in which said communication zone is closed when the stopper of the filler opening is in the closed position, wherein the closure member is equipped with return means for urging the closure member to return to the open position, and the stopper acts as an active pusher by applying thrust to said closure member, in opposition to the return means, while said stopper is going from the open position to the closed position.

2. A tank according to claim 1, wherein the stopper of the filler opening is thus in the form of a screw cap that is screwed onto the threaded neck of the filler opening of the tank when said stopper is in the closed position.

3. A tank according to claim 1, wherein the stopper of the filler opening is provided with a valve having a valve member and in which the valve member is mounted to move between an open position and a closed position, said valve member being suitable for going from the closed position to the open position beyond a predetermined "calibration" pressure inside the tank, at the filler opening of said tank.

4. A tank according to claim 1, wherein the tank is made up of two half-shells assembled together.

5. Regulator apparatus for regulating the liquid phase of a cooling circuit of an internal combustion engine, said regulator apparatus comprising a tank having two compartments, one of which is connected to the cooling circuit of said engine, and the other of which is connected to an auxiliary circuit, wherein the tank is a tank according to claim 1.

6. A tank according to claim 1, wherein the filler opening is extended into the tank by a dip tube provided with two "communication" openings that are mutually offset axially, the tube opening out into one of the compartments via one of said communication openings and the tube opening out into the other compartment via the other of said communication openings.

7. A tank according to claim 1, wherein the filler opening is extended into the tank by a dip tube provided with two "communication" openings that are mutually offset axially, the tube opening out into one of the compartments via one of said communication openings and the tube opening out into the other compartment via the other of said communication openings.

8. A tank according to claim 7, wherein the communication openings of the dip tube are provided in the vicinity of the free end of the dip tube.

9. A tank according to claim 7, wherein each compartment is provided with an air escape opening, which opens out into the dip tube.

10. A tank according to claim 7, wherein the closure member is in the form of a dip element provided with a sealing gasket positioned inside the dip tube, this sealing gasket being disposed at the level of the zone of the dip tube that is disposed between said openings of said tube when the stopper of the filler opening is in the closed position.

11. A tank according to claim 10, wherein the communication openings of the dip tube are provided in the vicinity of the free end of the dip tube.

12. A tank according to claim 1, wherein each compartment is provided with an air escape opening.

13. A tank according to claim 12, wherein the air escape opening of one of the compartments is provided with a valve having a valve member and in which the valve member is mounted to move between a closed position and an open position, said valve member being suitable for going from the closed position to the open position beyond a predetermined "calibration" pressure inside the tank compartment equipped with said valve (9).

14. A tank according to claim 13, wherein the valve of the air escape opening of one of the compartments is mounted to be constrained to move with the closure member for closing off the communication zone.

15. A tank according to claim 13, wherein the stopper of the filler opening is provided with a valve having a valve member and in which the valve member is mounted to move between an open position and a closed position, said valve member being suitable for going from the closed position to the open position beyond a predetermined "calibration" pressure inside the tank, at the filler opening of said tank, and the calibration pressure of the valve member of the valve equipping the air escape opening of one of the compartments is greater than the calibration pressure of the valve member of the valve equipping the closure stopper.

16. A tank according to claim 15, wherein the valve of the air escape opening of one (2) of the compartments is mounted to be constrained to move with the closure member (7) for closing off the communication zone.

* * * * *